US005671776A

United States Patent [19]

Minassian et al.

[11] Patent Number: 5,671,776

[45] Date of Patent: Sep. 30, 1997

[54] VALVE MOUNT ASSEMBLY

[75] Inventors: Alfred Minassian, Simi Valley; Donald J. Segien, Jr., Chatsworth; Paul F. Wilson, Palmdale, all of Calif.

[73] Assignee: Emhart Inc., Newark, Del.

[21] Appl. No.: 535,691

[22] Filed: Sep. 28, 1995

[51] Int. Cl.[6] ..... F16K 27/00

[52] U.S. Cl. ..... 137/606; 137/454.2; 251/360; 251/363

[58] Field of Search ..... 251/360, 362, 251/363; 137/606, 454.2

[56] References Cited

U.S. PATENT DOCUMENTS

| | | | |
|---|---|---|---|
| 1,315,828 | 9/1919 | Gillette | 251/363 X |
| 2,253,372 | 8/1941 | Fischer . | |
| 4,662,389 | 5/1987 | Igbal | 137/359 |
| 4,815,703 | 3/1989 | Antoniello | 137/606 X |
| 5,031,877 | 7/1991 | Mercer | 137/360 X |
| 5,232,008 | 8/1993 | Jeffress et al. | 137/15 |

FOREIGN PATENT DOCUMENTS

| | | | |
|---|---|---|---|
| 429192A1 | 10/1990 | European Pat. Off. . | |
| 084852 | 3/1976 | Taiwan . | |
| 153392 | 11/1920 | United Kingdom | 251/360 |

*Primary Examiner*—Stephen M. Hepperle
*Attorney, Agent, or Firm*—J. Bruce Hoofnagle

[57] ABSTRACT

An end body 34 is formed with a chamber 45 having a bevelled surface 62 and a cylindrical wall 60 in a portion thereof. A sleeve 46 is formed with an outward flange 48 at one end thereof and an annular bead 50 near another end 54 thereof. The sleeve 46 is formed with a press fit section 56 between the end 54 and the bead 50 thereof. The sleeve 46 is inserted axially into the chamber 45 of the end body 34 and the section 56 thereof is press fit into the cylindrical wall 60 of the end body with the bead 50 locating on the bevelled surface 62 of the end body. A valve 44 is threadedly attached to an end 58 of the end body 34 whereby a seal 64 of the valve engages the flange 48 of the sleeve 46. Water enters the end body 34 at the bottom thereof and flows into an axial passage 49 of the sleeve 46. If valve 44 is closed, the water will not flow any further. If the valve 44 is open, water will flow through the sleeve 46, the valve, the chamber 45 and out of the end body 34 to other facilities. The height of the end bodies 34 of different style assemblies could be different from each other. Rather than altering the length of the valve 44 to accommodate the different lengths of end bodies 34, the sleeve 46 is made in different lengths to accommodate the different lengths of end bodies.

18 Claims, 4 Drawing Sheets

VALVE MOUNT ASSEMBLY

BACKGROUND OF THE INVENTION

This invention relates to a valve mount assembly and particularly to a mount which includes a spacer for locating a valve supported on the mount.

In some faucet assemblies which are in use today, a plumbing structure referred to as an underbody is used to conduct water from inlet lines to a spout of an associated faucet. The underbody includes a pair of end bodies which are generally cylindrical and are spaced from each other. Each end body is formed with an axial passage which is open at opposite ends and with a lateral opening in a wall of the body. The underbody also includes a center body which is located centrally between the pair of end bodies. The center body is also formed with an axial passage which is open at one end and closed at the other end. A pair of lateral openings are formed in opposed sections of a wall of the center body adjacent the closed end and in communication with the axial passage. A pair of copper tubes are connected between the single lateral opening of each of the end bodies and a respective one of the pair of lateral openings of the center body.

An incoming cold water line is connected to one of the open ends of a respective one of the end bodies and an incoming hot water line is connected one of the open ends of the other of the end bodies. A first valve is connected to the remaining open end of a respective end body and a second valve is connected to the remaining open end of the remaining end body. The valves are located within the passages of the respective end bodies so that water is precluded from flowing from the inlet lines to the spout if the valves are closed. Typically, valve closure elements of the valve are located in the passage slightly inboard of the end thereof which is connected to the inlet line. Therefore, while a portion of the valve extends outward from the respective open end of the end body to facilitate operational control thereof, the remainder of the valve extends into the passage nearly to the opposite end thereof to locate the valve closure elements adjacent the opposite end of the end body. When the valve is opened, water is allowed to flow from the inlet line, through the open valve and into the passage of the end body. The water continues to flow into and through the copper tube, the passage of the enter body and into and out of the spout.

Usually, several different types of faucet assemblies are offered to customers to fulfill their decorative and practical needs. In some instances, the axial length of the end bodies of one faucet assembly is different from the axial lengths of the end bodies of each of several other faucet assemblies. Where different lengths of the end bodies are used with different types of faucet assemblies, valves of different lengths are required. Thus, several valves have to be manufactured to accommodate the different lengths of end bodies. This requires multiple manufacturing facilities, personnel and supplies to make valves which are of the same functional design except that their lengths are different. Once the valves of different lengths are made, they must be segregated at the manufacturing site for storage, distribution and assembly with an associated faucet assemblies. Also, where such valves of different lengths are offered for sale by wholesalers and retailers, segregated storage and shelf space is required.

Thus, there is a need for faucet assembly designs which provide an economical and practical solution to the above-described problems and the attendant disadvantages due to the requirement of providing valves of different lengths.

SUMMARY OF THE INVENTION

In view of the foregoing needs, it is an object of this invention to provide a valve mount assembly which is economical to manufacture and practical to store and handle.

Another object of this invention is to provide a valve mount assembly which can utilize valves of a common axial length even though the lengths of valve mounts of different valve mount assemblies are different.

With these and other objects in mind, this invention contemplates a valve mount assembly which includes a valve mount having a passage formed therein and structure formed at an end of the passage for supporting a valve. The assembly further includes an element located within the passage of the mount and having a first end and a second end spaced from the first end. The first end of the element is positioned within the passage and supported by the mount at a location spaced from the structure formed at the end of the mount. The second end of the element is positioned adjacent the structure for engagement with at least a portion of the valve when the valve is supported by the structure.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
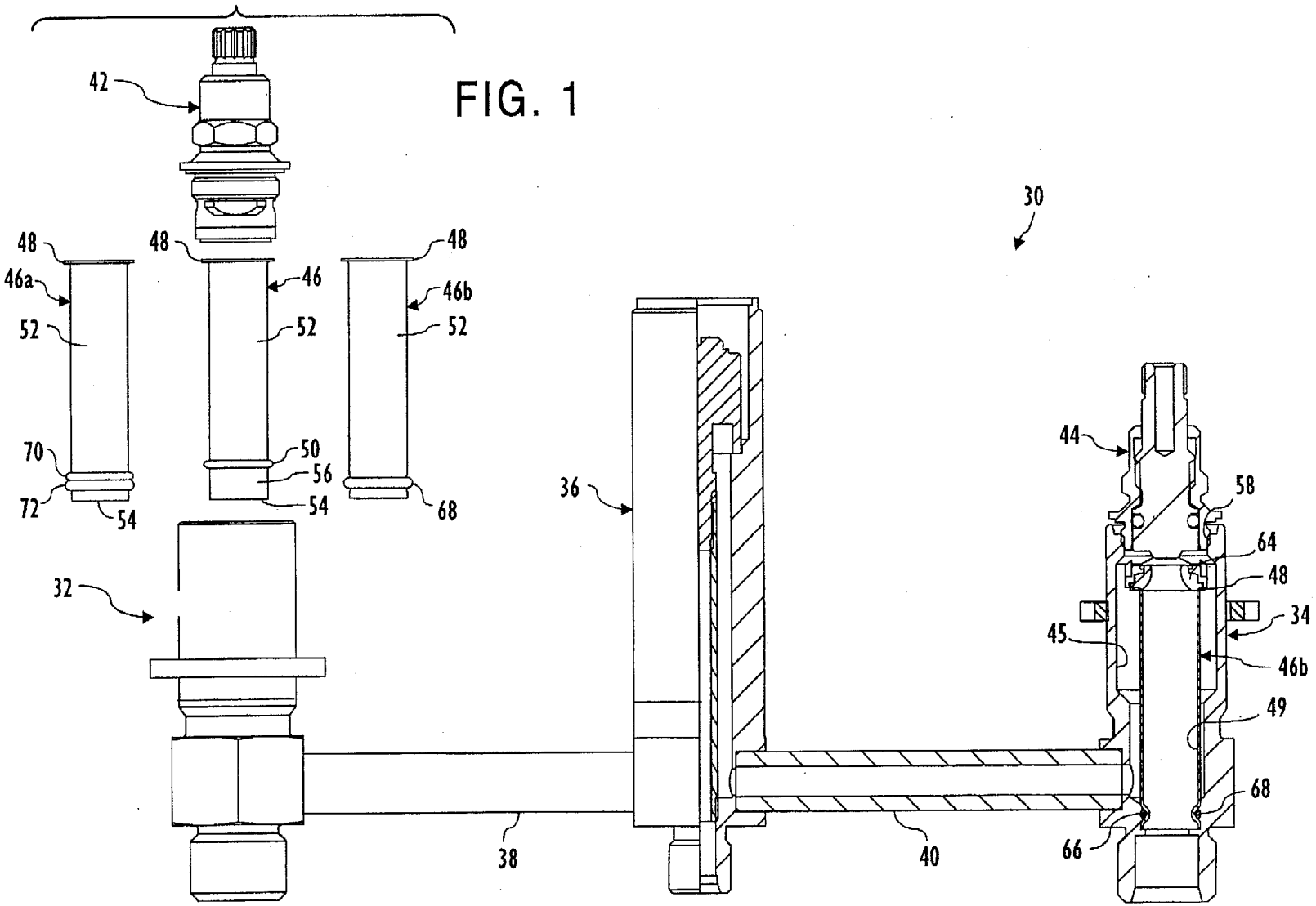
FIG. 1 is a partial sectional, partially exploded view showing an underbody of a plumbing assembly illustrating certain principles of the invention.

As shown in FIG. 1, a valve assembly 30 includes an underbody 31 formed by a pair of spaced end bodies 32 and 34, a center body 36 and a pair of conduits 38 and 40 which link the end bodies to the center body. In use of the valve assembly 30, water flows from supplies (not shown) into the bottom of the end bodies 32 and 34. By selective manual adjustment of a pair of valves 42 and 44 the water flows through the valves and through a chamber 45 formed axially through each of the end bodies 32 and 34. The water then flows through the conduits 38 and 40, respectively, through the center body 36 and through a spout (not shown) connected to the top of the center body.

The end bodies 32 and 34 for each type, of several different types, of valve assemblies 30 are of the same axial length. However, the axial length of the end bodies 32 and 34 of each type of valve assembly 30 is different from the axial lengths of the end bodies of the other types of valve assemblies. In the past, valves 42 and 44 of different lengths had to be provided to accommodate the different axial lengths of the end bodies 32 and 34.

Figure 2:
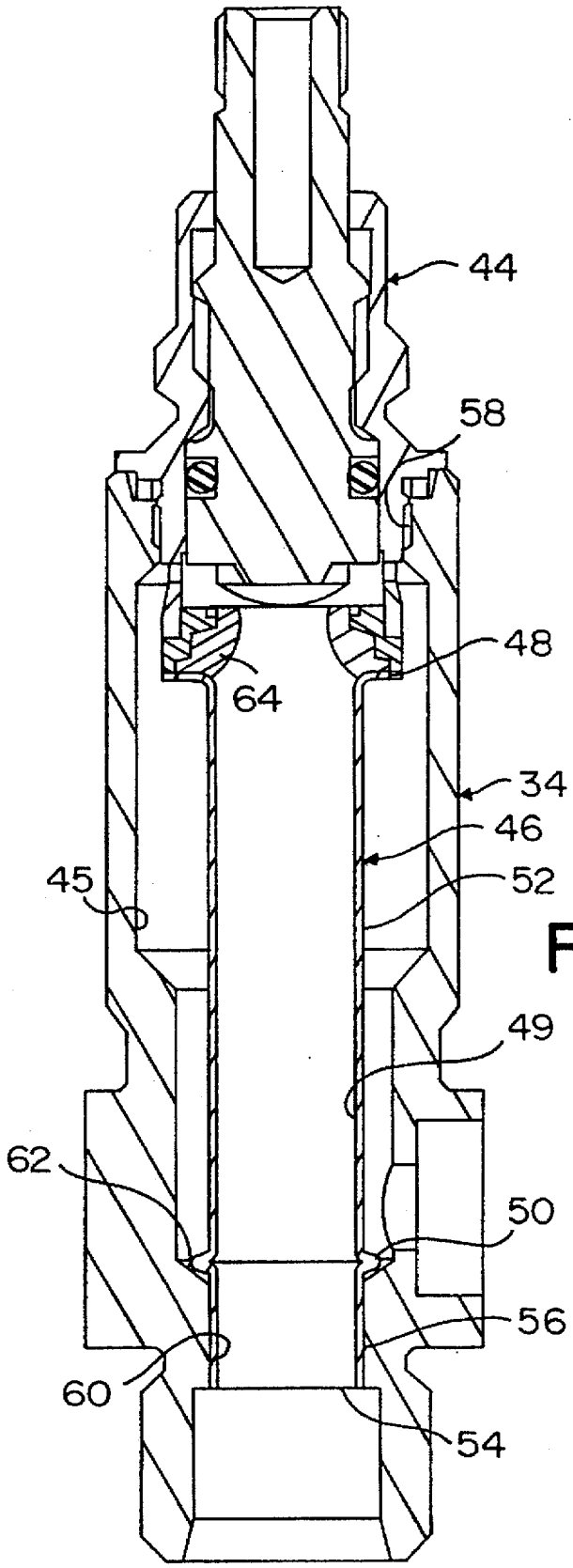
FIG. 2 is a sectional view showing an end body with a spacer sleeve and valve in assembly therewith in accordance with certain principles of the invention.

In the valve assembly 30 disclosed herein, a cylindrical spacer sleeve 46 is placed axially within the chamber 45 of each of the end bodies 32 and 34. The sleeve 46 is formed with a radially outward flange 48 at the upper end thereof. As illustrated in FIG. 2, the sleeve 46 is formed with an axial passage 49 which extends through the sleeve. The underbody 31 and the spacer sleeves 46 form a valve mount assembly.

Figure 3:
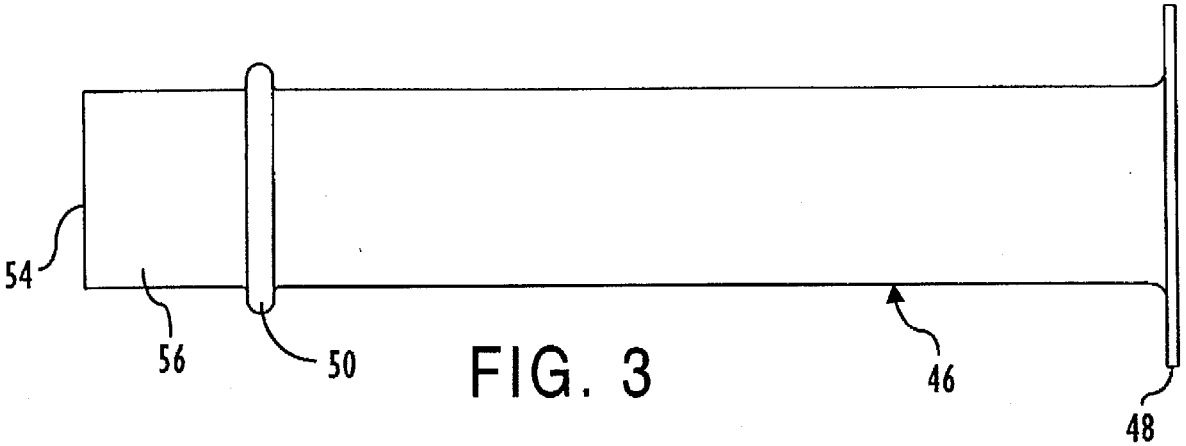
FIG. 3 is a side view of a preferred embodiment of the spacer sleeve of FIGS. 1 and 2 illustrating certain principles of the invention.
Figure 4:
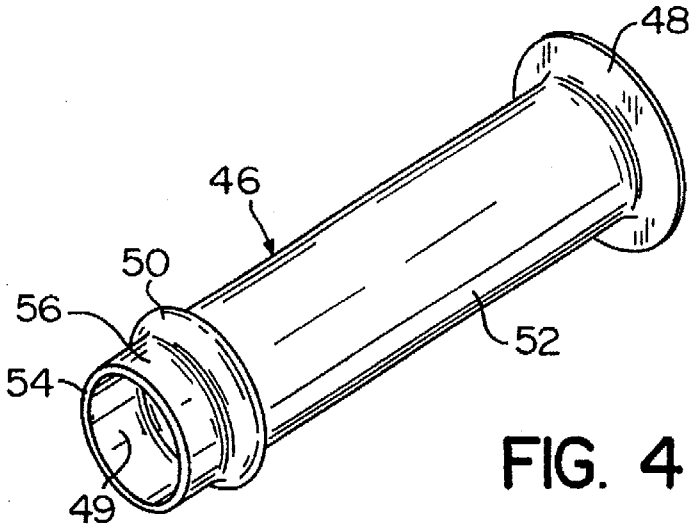
FIG. 4 is a perspective view showing the spacer sleeve of FIG. 3.

In the preferred embodiment as shown in FIGS. 2, 3 and 4, an annular rib or bead 50 is formed on an outer surface 52 of the sleeve 46 near a bottom end 54 thereof to define a press fit section 56 between the bottom end and the annular bead. When assembling the sleeve 46 within the end bodies 32 and 34, as viewed in FIG. 2, the bottom end 54 of the sleeve is inserted into an upper end 58of the chamber 45 of each of the end bodies 32 and 34. The sleeve 46 is moved fully and freely into each of the chambers 45 until the press fit section 56 begins to enter a space defined by a generally cylindrical wall 60 at the bottom of the chamber. The diameter of the wall 60 is slightly less than the diameter of the press fit section 56. Thus, some force is required to urge the press fit section 56 fully into the space defined by wall 60 whereby a press fit assembly is effected between the press fit section and the wall. The bead 50 engages a bevelled ramp 62 which is contiguous with the wall 60 to preclude further downward movement of the sleeve 46 within chamber 45. In this manner, a secure, water tight fit is obtained.

The valve 44 is inserted into and threadedly mounted in the upper end 58 of the chamber 45 of each of the end bodies 32 and 34 where a seal 64 at the bottom of the valve engages in sealing fashion the flange 48 of the sleeve 46 as shown in FIG. 2.

When water is supplied to the end bodies 32 and 34, the valves 42 and 44 can be selectively and manually operated to allow water to flow through the passage 49 of the sleeve 46, through the open valve 42 or 44 and into chamber 45 of the respective end body and around the exterior of the sleeve. The water continues to flow through the respective conduits 38 and 40, through the center body 36 and through the spout.

If a valve assembly 30 having end bodies 32 and 34 of equal axial length but different from the axial length of the just described valve assembly, spacer sleeves 46 of a different axial length are assembled with the end bodies in the same manner as described above. The valves 42 and 44 are then assembled as described above to complete the valve assembly 30.

In the above described two valve assemblies 30, the axial lengths of the end bodies 32 and 34 of the two assemblies are different. However, by using the sleeves 46 of different lengths in the two different valve assemblies 30, the same model of valve, for example valve 42, can be used with the different assemblies thereby eliminating the need to make and stock valves of different axial lengths.

Figure 5:
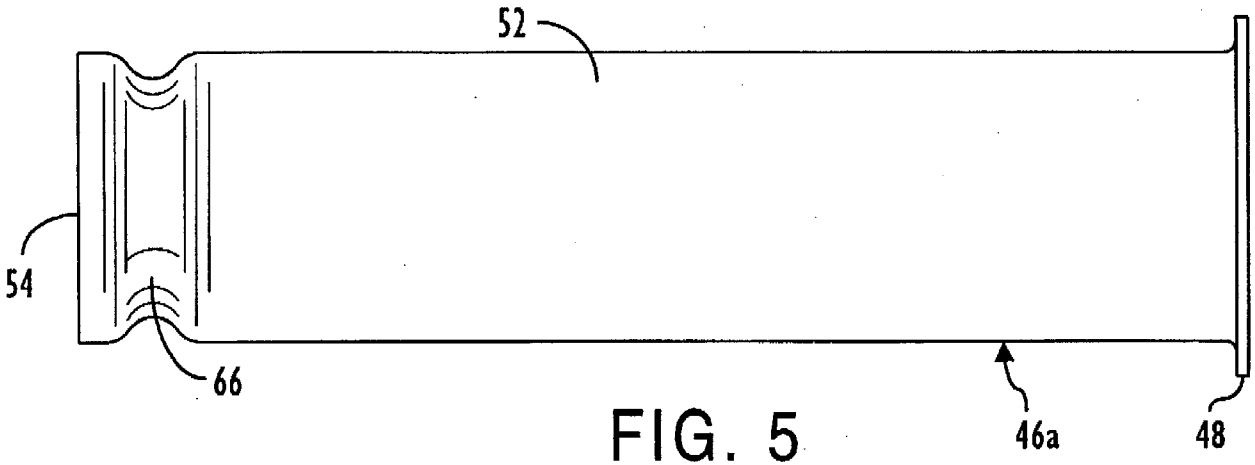
FIG. 5 is a side view of another embodiment of spacer sleeve embodying certain principles of the invention.
Figure 6:
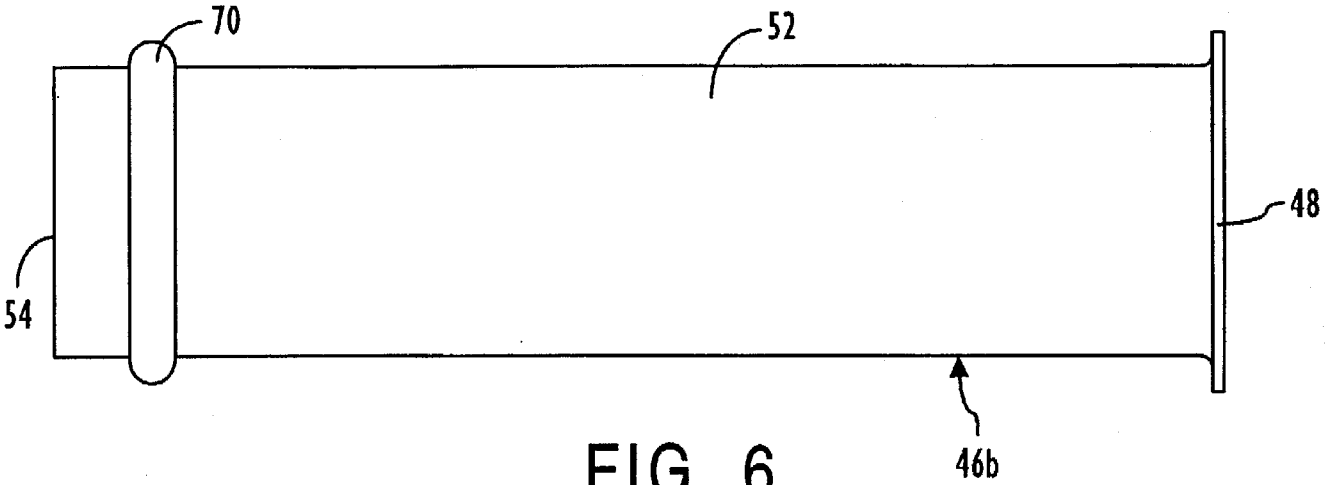
FIG. 6 is a side view of still another embodiment of a spacer sleeve embodying certain principles of the invention.

Two other embodiments of spacer sleeves **46*a* and 46*b* are illustrated in FIGS. 5 and 6 respectively. In FIG. 5, an annular groove 66 is formed in the outer surface 52 of the sleeve 46*a* for receipt of an O-ring 68 (FIG. 1). In FIG. 6, a bead 70 is formed in the outer surface 52 of the sleeve 46*b* near the bottom end 54 of the sleeve to provide a location for mounting an O-ring 72 against the underside of the bead as illustrated in FIG. 1. In the embodiments where the O-rings 68 and 72 are used, the cylindrical wall 60 is sufficiently large to receive the O-rings within the lower end of chamber 45 of the end bodies 32 and 34 to provide a secure and water-tight assembly in the same manner described above with respect to the sleeve 46 and the press fit section 56**.

In general, the above-identified embodiments are not to be construed as limiting the breadth of the present invention. Modifications, and other alternative constructions, will be apparent which are within the spirit and scope of the invention as defined in the appended claims.

What is claimed is:

1. A valve mount assembly, which comprises:

a valve mount having a passage formed therein;

structure formed on the valve mount at an end of the passage thereof for supporting a valve;

a sleeve located within the passage of the mount and having spaced first and second ends;

the first end of the sleeve being positioned within the passage and supported by the mount at a location spaced from the structure formed at the end of the mount;

the second end of the sleeve being positioned adjacent the structure for engagement with at least a portion of the valve when the valve is supported by the structure;

the sleeve being formed with an outward extending continuous bead about an intermediate portion thereof located closer to the first end than to the second end thereof;

the valve mount being formed with a bevelled surface in the passage thereof at a location spaced from the end of the passage;

a section of the sleeve between the first end and the bead thereof being assembled within a section of the passage adjacent the bevelled surface; and the bead of the sleeve being in engagement with the bevelled surface of the valve mount.

2. The valve mount assembly as set forth in claim 1 wherein the valve mount is generally cylindrical and the passage is an opening which extends axially through the mount.

3. The valve mount assembly as set forth in claim 1 wherein the end of the passage is open and the structure is a threaded section formed within the passage at least adjacent the end thereof.

4. The valve mount assembly as set forth in claim 1 wherein the sleeve is formed with an outward flared flange at the second end thereof.

5. The valve mount assembly as set forth in claim 1, which further comprises.:

the sleeve being formed with an outward extending continuous bead about an intermediate portion thereof located closer to the first end than to the second thereof;

a compliant member mounted on the section of the sleeve between the first end and the bead thereof; and the compliant member being located in the passage of the valve mount at a position spaced from the end thereof and between a wall of the passage and the section of the sleeve on which the compliant member is mounted.

6. The valve mount assembly as set forth in claim 1, which further comprises:

the sleeve being formed with a groove on an outer surface thereof in an intermediate portion of the sleeve closer to the first end than to the second end thereof;

a compliant member mounted in the groove with portions of the compliant member extending outward from the groove; and the compliant member being located in the passage of the valve mount at a position spaced from the end thereof and between a wall of the passage and the groove of the sleeve.

7. The valve mount assembly as set forth in claim 1, wherein the section of the sleeve is press fit into engagement with the section of the passage.

8. The valve mount assembly as set forth in claim 1, wherein the valve mount is an end body which forms a portion of an underbody of a plumbing assembly.

9. The valve mount assembly as set forth in claim 8, wherein the end body is a first end body and the assembly further comprises:

a second end body spaced from the first end body and having a passage formed therethrough;

structure formed on the second end body at an end of the passage thereof for supporting a second valve;

a second element located within the passage of the second end body and having a first end and a second end;

the first end of the second element being positioned within the passage of the second end body and supported by the second end body at a location spaced from the structure formed at the end of the second end body; and the second end of the second element being positioned adjacent the structure of the second end body for engagement with at least a portion of the second valve when the second valve is supported by the structure of the second end body.

10. The valve mount assembly as set forth in claim 9, wherein the first and second end bodies are linked through a center body and a pair of conduits which extend the center body and a respective one of the first and second end bodies.

11. The valve mount assembly as set forth in claim 9, wherein the second element is a sleeve.

12. The valve mount assembly as set forth in claim 11, wherein the sleeve is formed with an outward flared flange at the second end thereof.

13. The valve mount assembly as set forth in claim 11, wherein the sleeve is formed with an outward extending continuous bead about an intermediate portion thereof located closer to the first end than the second end thereof.

14. The valve mount assembly as set forth in claim 13, wherein:

the second end body is formed with a bevelled surface in the passage thereof at a location spaced from the end of the passage;

a section of the second sleeve between the first end and the bead thereof is assembled within a section of the passage adjacent the bevelled surface; and the bead of the sleeve is in engagement with the bevelled surface of the second end body.

15. The valve mount assembly as set forth in claim 14, wherein the section of the sleeve is press fit into the section of the passage.

16. The valve mount assembly as set forth in claim 11, which further comprises a compliant member positioned on the sleeve adjacent the first end thereof.

17. The valve mount assembly as set forth in claim 16, wherein the compliant member is located in the passage of the second end body at a position spaced from the end thereof and between a wall of the passage of the second end body and a portion of an outer surface of the sleeve.

18. A valve mount assembly, which comprises:

a valve mount having a passage formed therein;

structure formed on the valve mount at an end of the passage thereof for supporting a valve;

an element located within the passage of the mount and having spaced first and second ends;

the first end of the element being positioned within the passage and supported by the mount at a location spaced from the structure formed at the end of the mount; and the second end of the element terminating in a flange and positioned adjacent the structure for engagement with at least a portion of the valve when the valve is supported by the structure;

the passage formed with a wall which extends between a first end and a second end of the valve mount;

an inwardly extending shelf formed on the wall at a prescribed location; and an outwardly extending rib formed on the element at a prescribed location in engagement with the shelf.

* * * * *